United States Patent [19]

Reim

[11] 4,078,326

[45] Mar. 14, 1978

[54] FRAME FOR PICTURES AND LIKE OBJECTS

[76] Inventor: Paul Reim, Rathausgasse 5, D-71 Heilbronn, Germany

[21] Appl. No.: 651,468

[22] Filed: Jan. 22, 1976

[30] Foreign Application Priority Data

Apr. 25, 1975 Germany ..... 2518365

[51] Int. Cl.[2] ..... G09F 1/12

[52] U.S. Cl. ..... 40/152.1

[58] Field of Search ..... 40/155, 152, 156, 152.1

[56] References Cited

U.S. PATENT DOCUMENTS

| | | | |
|---|---|---|---|
| 2,016,942 | 10/1935 | Horwitt et al. | 40/152.1 |
| 2,663,105 | 12/1953 | Woodbury | 40/152 |
| 2,777,232 | 1/1957 | Kulicke et al. | 40/155 |
| 3,541,714 | 11/1970 | Bruck | 40/156 |
| 3,611,604 | 10/1971 | Saltzman | 40/152 |
| 3,654,719 | 4/1972 | Rochelt | 40/156 |

*Primary Examiner*—Russell R. Kinsey
*Assistant Examiner*—Wenceslao J. Contreras

[57] ABSTRACT

A frame for pictures and like objects includes a plurality of frame parts which bound an opening in which the object is to be displayed and each of which has front and rear engaging portions spaced from each other. Intermediate the front and rear engaging portions of the frame parts, a transparent plate, the object to be displayed, a resilient elastically-compressible foam material insert, and a support plate which is connected with the frame parts are respectively located. The resilience of the insert urges the support plate against the rear engaging portions on the one hand and simultaneously urges both the object and the transparent plate against the front engaging portion on the other hand so as to be securely retained therebetween.

15 Claims, 4 Drawing Figures

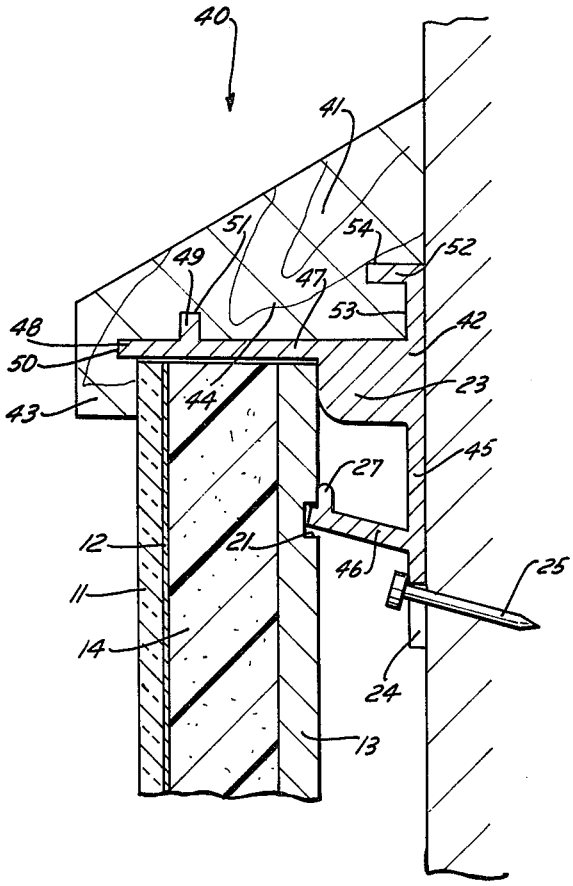
FIG. 4
FIG. 3
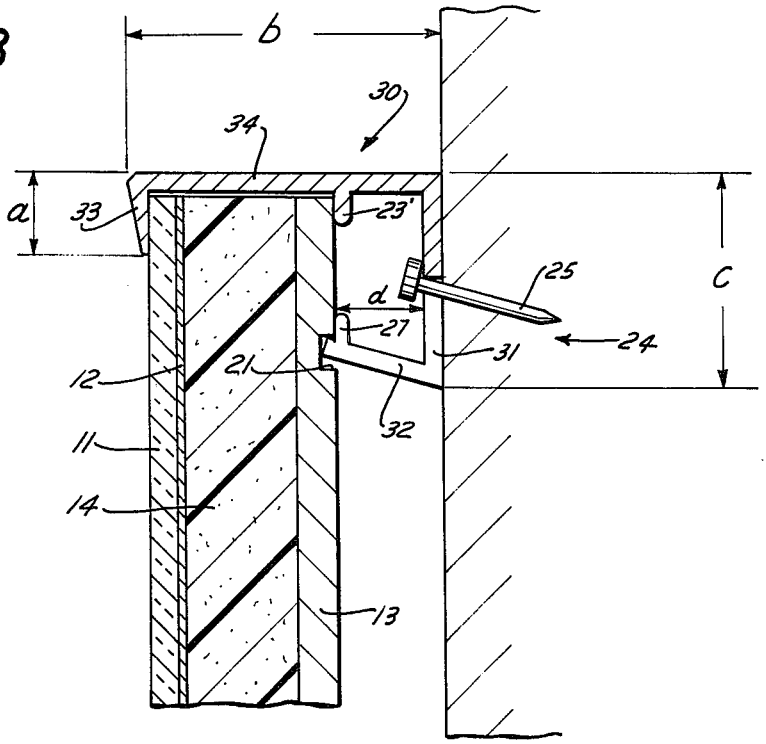

FRAME FOR PICTURES AND LIKE OBJECTS

BACKGROUND OF THE INVENTION

The present invention relates to frames for displaying objects and, more particularly, to improvements in picture frames.

Picture frames are known which are comprised of a plurality of frame parts each of which are securely connected to each other in their corner regions. Also known are picture frames whose individual parts abut, i.e. are unconnected with, each other and, instead, are connected to a rear support plate so that the frame can be mounted and hung without its individual parts coming apart.

It is also known in the prior art to use springs for connecting the rear support plate to the individual frame parts. Such springs which are exposed on the rear side of the frame are mounted on the rear support plate. Since a precise arrangement of the springs is essential for a clean, neat abutment of the individual frame parts, the picture frame of the prior art is quite expensive in spite of the fact that some cost savings has occurred by eliminating the need for directly connecting the individual frame parts to each other. Another disadvantage of the prior art frame is the unaesthetic appearence of the frames due to the fact that the springs are visible at the rear side of the frame. In addition, the location of the springs tends to prevent proper cleaning of the frame.

SUMMARY OF THE INVENTION

Accordingly, it is the general object of the present invention to overcome the disadvantages of the prior art.

Another object of the present invention is to simplify the construction of picture frames.

An additional object of the present invention is to reduce the cost of manufacture of picture frames.

Still another object of the present invention is to improve the aesthetic appearance of picture frames.

Yet another feature of the present invention is to provide a neat, clean abutment-type joint between the individual frame parts.

In keeping with these features and others which will become apparent hereinafter, one feature of the invention resides, briefly stated, in a frame for pictures and like objects which comprises a plurality of frame parts bounding an opening in which an object is to be displayed. Each frame part has front and rear engaging portions which are spaced at a predetermined distance with respect to each other. The frame further comprises a support plate and means for connecting the same with the frame parts. Finally, biasing means such as a resilient, elastically-compressible material insert, is located intermediate the support plate and the object to be displayed in the frame for urging the object and the support plate respectively towards the front and rear engaging portions so as to be securely retained therebetween.

In accordance with another feature of the present invention, a transparent plate may be located intermediate the object to be displayed and the front engaging portions so as to be frictionally engaged thereat in response to the action of the biasing means.

The cooperation among the above-described elements of the frame overcomes the disadvantages of the prior art in an economical manner. The placement of the resilient insert between a rigid support plate and the object to be displayed permits not only the object to be securely supported in the frame, but also fixes the position of the individual frame parts to the just-described layered sub-assembly relative to each other. The frame parts need not be additionally connected in their corner regions and can be mounted to a wall or like supporting structure without the individual frame parts becoming detached from each other.

Inasmuch as the resilient insert is located between the support plate and the object in the interior of the frame parts, it will be hidden to an observer, thus improving the aesthetic appearance of the frame. Of course, a considerable cost savings is obtained since the present invention obviates the need for precisely locating springs on the support plate, as taught by the prior art. Another advantageous feature of the present construction is that the depth of the frame may be varied by interchanging differently-sized resilient elements and corresponding frame parts without having to interchange the support plate, as was previously made necessary by the prior art.

Yet another advantageous feature of the invention is that the biasing means or the resilient insert is constituted of elastically-compressible foam material. This material prevents possible damage to the object. Also, this material substantially eliminates the tendency of the object to slip or shift relative to the other parts of the frame. It is further preferable if the resilient insert is of sheet-like configuration so that it covers the entire rear surface of the object so that the latter is thereby equally and uniformly supported by the support plate over its entire area. This feature prevents the object, particularly when it is not sufficiently rigid, from flexing or buckling in the frame.

In accordance with still another feature of the invention, each frame part further comprises an inclined projection which is received in a recess formed on the support plate, whereby an extremely simple and quick connection between the support plate and the frame parts is realized without the occurrence of any shifting of the former to the latter. The provision of the inclined projection does not overly increase the manufacturing cost since the entire frame part can be extruded at one time.

In addition, it is advantageous when the total depth of each frame part, i.e. the distance from the wall, is larger than the combined width of the support plate, resilient insert, object to be displayed, and transparent plate (if necessary) and when the inclined projection extends outwardly in part across this distance so that the impression can be created of a very deep frame without having to provide a thicker and therefore costlier resilient insert.

The invention further features generally key- or wedge-shaped notches, preferably of generally V-shaped configuration, on the frame parts which eliminate the need for conventional hooks or lugs.

Yet another feature is embodied in constructing each frame part out of two interconnected components, one of which includes the front engaging portion and the other of which includes the rear engaging portion. The first component overlies the second component and its shape and material are selected so as to be aesthetically pleasing, for example it may be made of wood and tapered to create the impression of a heavy, massive frame. The second component is hidden and is generally selected from material which either has high strength characteristics or high elastic characteristics.

The components are affirmatively interconnected by providing the first element with extension portions which are frictionally received or wedged in correspondingly-shaped grooves provided in the second component.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view analogous to FIG. 2 showing another embodiment; and

FIG. 4 is a view analogous to FIG. 2 showing yet another embodiment.

Figure 1:
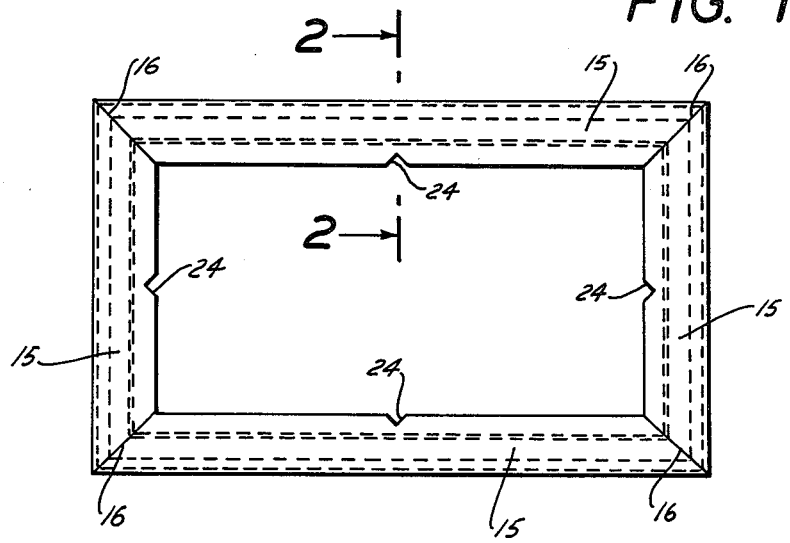
FIG. 1 is a rear view of a frame in accordance with the present invention.
Figure 2:
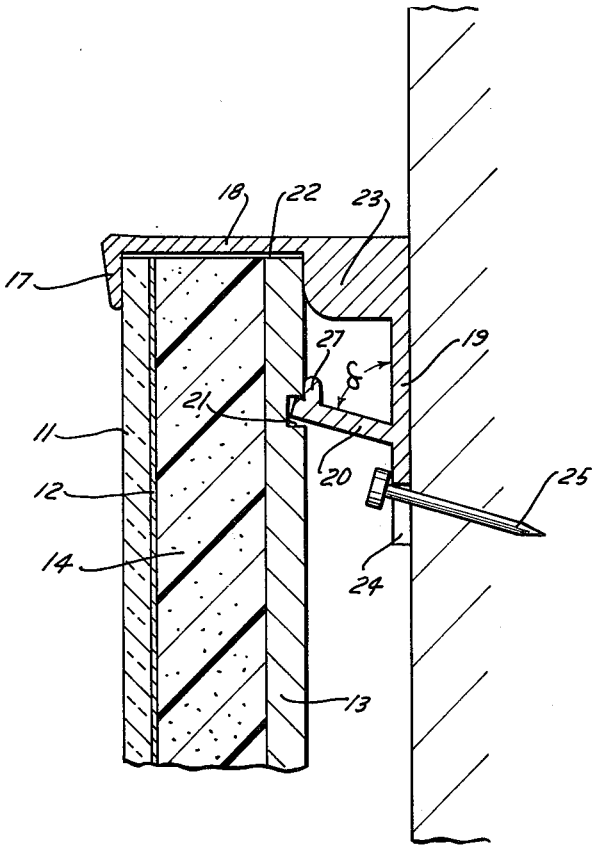
FIG. 2 is an enlarged side view in vertical section of one embodiment as seen along the line 2—2 of FIG. 1.

DESCRIPTION OF THE PREFERRED EMBODIMENTS:

Referring firstly to the embodiment illustrated in FIGS. 1 and 2 of the drawing, it will be seen that reference numeral 10 generally identifies a frame for pictures and analogous objects. The frame 10 is comprised of a plurality of frame parts 15 which bound an opening in which the object is to be displayed. Each frame part 15 is provided with a front engaging portion, such as front leg 17 in FIG. 2, which is spaced a predetermined distance from a rear engaging portion, such as projection 23.

The picture or analogous object 12 is arranged so as to be visible through the opening bounded by the frame parts 15. In front of the object 12, i.e. to the right of front leg 17, as shown in FIG. 2, a transparent plate 11 which is preferably constituted of glass or of transparent synthetic plastic material may be situated. The transparent plate may be omitted if the object 12 is constituted of a self-supporting material. On the rear of the object 12, a protective coating, which has not been illustrated for the sake of clarity in the drawing, can be provided to protect the object 12.

A rear support plate 13, which is constituted of any rigid, stiff material, such as molded fiber board, is positioned adjacent the rear engaging portion 23. Intermediate the support plate 13 and the object 12, an elastically-compressible insert 14, which is constituted of any resilient material, such as foam material, is located.

The resilient insert 14 generally covers the entire surface area of the support plate 13 so that all regions of the object 12 are equally and uniformly supported by the insert 14 cooperating with the support plate 13. However, it will be understood that it is sufficient that the insert 14 be constituted of resilient strips which are provided only in the border regions of the frame parts 15. Of course, the insert 14 need not be strip-shaped and may have any configuration. Moreover, the resilient insert 14 need not be of foam material, but may be any equivalent biasing means, such as a spring.

Thus, the transparent plate 11 on one side of the object 12 and the support plate 13 at the other side of the object 12 with the intermediately-located resilient insert 14, as well as further inserts, are urged towards the inner contact surfaces of the front engaging portion 17 and of the rear engaging portion 23 so as to be frictionally secured thereto. Each frame part 15 is provided with a miter 16 at its opposite ends so that an abutment-tyoe joint is formed.

The cross-sectional profile of frame part 15 is shown in FIG. 2. The frame part 15 may be constituted of any shape-holding material, such as metal or synthetic plastic material, just to mention a few possibilities. It is preferable if the part 15 is of synthetic plastic material since the illustrated cross-section may very advantageously be manufactured by extrusion techniques and thereafter cut to random lengths.

Middle portion 18 extends inbetween the front leg 17 and rear engaging portion 23 in a direction substantially normal to the front leg 17 so that the latter is spaced a predetermined distance from the rear engaging portion 23. Mounting portion 19, which abuts against and is mounted to a wall or other supporting structure, extends in direction generally parallel to front leg 17, i.e. substantially normal to the elongation of middle portion 18. Mounting portion 19 is spaced from front leg 17 at a distance which is greater than said aforementioned predetermined distance so as to keep the mounting portion away from the support plate 13.

In this latter region between the support plate 13 and the mounting portion 19, connecting means are located which comprise a supporting ledge or inclined projection 20 which is partially received in recess 21 formed in the support plate 13. The projection 20 is integral with and inclined relative to the mounting portion 19 at an angle $\alpha$ in direction towards middle portion 18 until the projection 20 partially overlies the middle portion 18. The angle $\alpha$ is preferably under 90°, although it can also be 90°.

The recess 21 has an open end through which the free end of the inclined projection 20 is received until abutment portion 27, which extends in upward direction towards said middle portion 18 and which is generally parallel to mounting portion 19, abuts against the support plate 13 so that the free end of projection 20 is maintained out of direct physical contact with the closed end of the recess 21. The recess 21 is formed as a groove which extends parallel to the edge 22 into the plane of FIG. 2, thus simplifying the lateral adjustment of each frame part along the elongation of the groove.

The rear engaging portion 23 illustrated in FIG. 2 has a quadrilateral cross-sectional configuration with one of the sides thereof serving as a contact surface for engagement with the rear side of the support plate 13. The lower inwardly-lying section of the contact surface which is adjacent the support plate 13 is rounded off or broken away so as to simplify the insertion of the support plate 13, insert 14, object 12 and transparent plate 11 into the space defined between the front and rear engaging portions. The contact surface of the rear engaging portion 23 lies in a common plane with the contact surface of abutment portion 27. Thus, the support plate 13 is accurately oriented in the frame.

Generally V-shaped notches 24 are formed in the mounting portions 19 which cooperate with a nail or analogous fastener 25 to simplify the mounting of the frame parts 15 to the wall without the use of conventional hooks or lugs.

In order to insert a picture or like object in the above-described frame, the object 12 is first placed over the rear side of the transparent plate 11. It will be remembered that the transparent plate may be omitted, if desired. Over the rear side of the object 12 — which may or may not be provided with a protective coating, as desired — the resilient insert 14 is placed. Thereupon, the support plate 13 is placed over the rear side of the insert 14.

Next, the frame parts 15 are pushed over the respective borders of the layered sub-assembly. The predetermined distance between the front and rear engaging portions is slightly smaller than the combined width of the layered sub-assembly so that the resilient insert 14 is compressed and thereby operative for generating an outwardly-directed restoring force due to its inherent tendency to return to its original expanded condition. This restoring force permits the frame parts 15 to be held onto the layered sub-assembly without any further fastening aids and also permits proper seating of the projection 20 in the recess 21. Thus, the mitered ends of the frame parts 15 properly abut each other and form a neat, aesthetically-pleasing joint 16 without gaps.

The frame may now be mounted on a wall or like supporting structure by driving a nail 25 or analogous fastener through a notch 24 which is preferably generally V-shaped so as to prevent lateral shifting of the frame with respect to the wall.

In the embodiment of FIG. 3, like reference numerals identify analogous parts already discussed above with respect to FIG. 2; hence, a detailed discussion of these similar features is not believed to be necessary. This embodiment is differentiated from that of FIG. 2 in the following ways: First, the frame parts 30 comprise a mounting portion 31 whose V-shaped notch 24 is located not at its lower end region, as in FIG. 2, but at its central region. Secondly, the inclined projection 32 does not extend outwardly of the central region of its mounting portion, as shown in FIG. 2, but is inclined upwardly from the lowermost end of the mounting portion 31 and is received in transverse recess 21.

Thirdly, the rear engaging portion 23' does not have a generally quadrilateral configuration which fills up the entire corner region formed between the middle portion 18 and the mounting portion 19. Instead, the rear engaging portion has the configuration of projection 23' which is spaced from both the front engaging portion 33 and the mounting portion 31 and which extends in direction generally parallel thereto. Projection 23' has a rounded corner to facilitate insertion of the layered sub-assembly. It will be understood that other equivalent cross-sectional configurations are possible for the rear engaging portion and other locations are also feasible for the inclined projection 32.

A feature common to the embodiments of FIGS. 2 and 3 is that they are both of one-piece construction, i.e. the front engaging portion is of one piece with the remaining portion of the frame part. The frame parts may be colored, but it is preferable if at least the front engaging portion, i.e. legs 17 or 23, are transparent so that the border regions of the object 12 will also be visible.

In FIG. 3, I have found that the following cross-sectional dimensions are advantageous: The overall length of front leg 33, dimension *a*, about 4 millimeters; the overall depth of frame part 30 from front leg 33 to mounting portion 31, dimension *b*, about 17 millimeters; the overall length of mounting portion 31 from middle portion 34 to the inclined projection 32, dimension *c*, about 11 millimeters; and the distance from the inner surface of mounting portion 31 to the plane in which the contact surfaces of abutment portion 27 and projection 23' lie, dimension *d*, about 3 millimeters.

Finally, in the embodiment of FIG. 4, again like numerals identify like parts as described in connection with FIG. 2. Each frame part 40 is now not of one-piece construction but is of two-piece construction and is comprised of components 41 and 42. Components 41 and 42 may be constituted of the same material or of different material, as desired. In FIG. 4, component 41 is constituted of wood and component 42 is constituted of metal. It will be understood that the choice of material for component 41 is primarily dictated by aesthetic reasons, since component 41 overlies component 42 and is therefore the only component which is visible to an observer. The choice of material for component 42 is less dictated by aesthetic reasons and is chosen more for its stability and strength; for example, synthetic plastic material or metal material may be used.

Component 42 comprises body portion 47, the rear engaging portion 23, mounting portion 42 and the inclined projection 46 — all of whose details have already been disclosed above. On the other hand, component 41 comprises a tapered central portion 44 and a front engaging portion 43 which partially overlaps the transparent plate 11, as previously noted.

In order to affirmatively interconnect the two components 41 and 42, the body portion 47 comprises a first extension 48 and a second extension 49 which are frictionally lodged in cooperating grooves 50 and 51 which are formed in the central portion 44. The extensions 48 and 49 preferably extend in direction normal to each other. In addition, component 41 includes an L-shaped portion 52 whose stem 53 extends upwardly in the direction of the elongation of mounting portion 45 and whose cross bar extends normally thereto towards the interior of central portion 44. L-shaped portion 52 is frictionally mounted in a cooperating L-shaped recess 54.

The above-described embodiments are merely exemplary embodiments of the invention. Many modifications are feasible without changing the intended scope of the invention. For example, as noted above, the transparent plate can be omitted if the object is sufficiently inherently rigid or can be replaced by a rigid mask which overlies the border regions of the object. Also, the foam material resilient insert 14 located between the object 12 and the support plate 13 may cover the entire or a major portion of the outer surface thereof. Instead of having a sheet-like configuration, the insert 14 may be constituted of strips placed in the border regions of the object. Alternatively, the insert 14 may be replaced by any analogous type of biasing means, such as springs.

Moreover, the length of the various mounting portions, middle portions, front and rear engaging portions and inclined projections may be increased or shortened. The mounting portion may be so shaped in its middle region and its inclined projection so shortened that they are directly situated at the outer side of the support plate. Finally, the frame may replace the means for hanging it on a wall with means for mounting it on any planar surface.

It will be understood that each of the elements described above, or two or more together, may also find a useful application in other types of constructions differing from the types described above.

While the invention has been illustrated and described as embodied in a frame for pictures and like objects, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A frame assembly comprising:
a generally polygonal rigid support plate having a plurality of straight sides and having a front face and a back face, said back face being formed inwardly of and parallel to each of said sides with a backwardly open straight groove extending substantially the full length of the respective side;
a front panel generally congruent to said support plate and having a plurality of sides each spaced from and juxtaposed with a respective side of said support plate;
a plurality of straight, rigid, generally inelastic, and elongated frame parts each extending along a respective side of said support plate, each having a pair of opposite mitred ends abutting flatly with the corresponding ends of the neighboring frame parts, and each integrally formed with
a middle portion extending parallel to and adjacent a respective side of said support plate and the corresponding side of said panel,
a front portion extending parallel to, from, and substantially the full length of the respective middle portion and overreaching the respective side of said front panel,
a rear portion extending parallel to, from, and substantially the full length of the respective middle portion and overreaching the respective side of said support plate, whereby said front panel, and said support plate are sandwiched and held between said front and rear portions,
a mounting portion extending parallel to, from, and substantially the full length of the respective middle portion, said rear portions each being between the respective mounting and front portions,
a support portion extending parallel to, from and substantially the full length of the respective mounting portion, said support portions each projecting forwardly from the respective mounting portion toward the respective front portion and each having a free end edge engaged in the respective groove of said support plate, and
an abutment portion extending parallel to, from, and substantially the full length of the respective support portion and bearing against said back face of said support plate adjacent the respective groove thereof; and
means including an elastic cushion between said front panel and said front face for urging said front panel elastically forwardly against said front portions and for urging said support plate backwardly elastically against said abutment portions without substantial deformation of said frame parts.

2. The assembly defined in claim 1 wherein said plate and said panel are substantially rectangular and said mitered ends extend at substantially 45° to the direction of elongation of the respective frame parts.

3. The assembly defined in claim 1 wherein said front and rear portions are substantially planar and parallel and said middle portion is substantially planar and perpendicular to said front and rear portions.

4. The assembly defined in claim 1 wherein said front panel and said plate are substantially planar and spaced apart.

5. The assembly defined in claim 1 wherein said front panel is transparent.

6. The assembly defined in claim 1 wherein said cushion is of elastically compressible foam material.

7. The assembly defined in claim 1 wherein said cushion is a resilient sheet extending over substantially all of said front face.

8. The assembly defined in claim 1 wherein each of said support portions forms an acute angle with the respective mounting portion.

9. The assembly defined in claim 1 wherein each free end edge of each support portion is closer to the respective front portion than the respective rear portion.

10. The assembly defined in claim 1 wherein each rear portion has remote from the respective mounting portion a rounded corner edge.

11. The assembly defined in claim 1 wherein each of said grooves has a base and each of said free end edges is spaced from the respective base.

12. The assembly defined in claim 1 wherein each of said front portions has a planar rear surface and each of said rear portions and the respective abutment portion forms a plane parallel to the respective rear surface.

13. The assembly defined in claim 1 wherein each of said mounting portions is formed with a notch open away from the respective middle portion.

14. The assembly defined in claim 1 wherein each of said frame parts is of one-piece construction.

15. A frame assembly comprising:
a generally polygonal rigid support plate having a plurality of straight sides and having a front face and a back face, said back face being formed inwardly of and parallel to each of said sides with a backwardly open straight groove extending substantially the full length of the respective side;
a front panel generally congruent to said support plate and having a plurality of sides each spaced from and juxtaposed with a respective side of said support plate;
a cushion between said panel and said front face of said support plate urging same apart; and
a plurality of straight and elongated frame parts each integrally formed with
a middle portion extending parallel to and substantially the full length of a respective side of said support plate and the corresponding side of said panel, a front portion extending parallel to, from, and substantially the full length of the respective middle portion and overreaching the respective side of said front panel,
a rear portion extending parallel to, from, and substantially the full length of the respective middle portion and overreaching the respective side of said support plate, whereby said front panel, cushion, and support plate are sandwiched and held between said front and rear portions,
a mounting portion extending parallel to, from, and substantially the full length of the respective middle portion, said rear portions each being between the respective mounting and front portions, at least one of said mounting portions being formed with a hanging notch substantially equidistant between the ends of the respective frame part and opening away from the respective middle portion, a support portion extending parallel to, from, and substantially the full length of the respective mounting portion, said support portions each projecting forwardly from the respective mounting portions between the respective side portion and the respective notch toward the respective front portion and each having a free end edge engaged in the respective groove of said support plate, and an abutment portion extending parallel to, from, and substantially the full length of the respective support portion and bearing resiliently against said back face of said support plate adjacent the respective groove thereof.

* * * * *